US005374906A

United States Patent [19]

Noguchi et al.

[11] Patent Number: 5,374,906

[45] Date of Patent: Dec. 20, 1994

[54] FILTER DEVICE FOR TRANSMITTER-RECEIVER ANTENNA

[75] Inventors: Toshiharu Noguchi; Kuniaki Kiyosue; Takehiko Yoneda, all of Miyazaki, Japan

[73] Assignee: Matsushita Electric Industrial Co., Ltd., Osaka, Japan

[21] Appl. No.: 97,185

[22] Filed: Jul. 27, 1993

[30] Foreign Application Priority Data

Jul. 29, 1992 [JP] Japan ..... 4-202183

[51] Int. Cl.[5] ..... H01P 1/213

[52] U.S. Cl. ..... 333/134; 333/206; 333/222

[58] Field of Search ..... 333/126, 134, 202, 206, 333/222; 455/78, 80, 82

[56] References Cited

U.S. PATENT DOCUMENTS

| | | | |
|---|---|---|---|
| 4,506,241 | 3/1985 | Makimoto et al. | 333/222 |
| 4,985,690 | 1/1991 | Eguchi et al. | 333/206 X |
| 5,065,119 | 11/1991 | Jackowski | 333/202 |
| 5,124,676 | 6/1992 | Ueno | 333/206 |
| 5,250,916 | 10/1993 | Zakman | 333/134 X |

FOREIGN PATENT DOCUMENTS

| | | |
|---|---|---|
| 63-206016 | 8/1988 | Japan . |
| 272701 | 3/1990 | Japan . |
| 3117911 | 12/1991 | Japan . |

*Primary Examiner*—Paul Gensler
*Attorney, Agent, or Firm*—Lowe, Price, LeBlanc & Becker

[57] ABSTRACT

A filter device for a transmitter-receiver antenna includes a transmission side filter having resonators and a reception side filter having resonators. Each of the transmission side resonators has a first characteristic impedance ratio other than one. On the other hand, each of the reception side resonators has a second characteristic impedance ratio being set to a value which prevents spurious resonance of the reception side filter at an integral multiple of a fundamental resonance frequency of the transmission side filter, so as to avoid the situation where spurious components increase at the above-noted integral multiple in a frequency characteristic of the transmission side filter being affected by a frequency characteristic of the reception side filter.

17 Claims, 13 Drawing Sheets

FILTER DEVICE FOR TRANSMITTER-RECEIVER ANTENNA

BACKGROUND OF THE INVENTION

1. Field of the Invention

The present invention relates generally to a filter device, such as, a duplexer or a separation filter, for a transmitter-receiver antenna, which is used to separate a transmission signal and a reception signal. More specifically, the present invention relates to the above-noted filter device to be used in an antenna circuit for an automobile telephone system, a portable telephone system and the like.

2. Description of the Prior Art

There has been proposed, as disclosed in U.S. Pat. No. 4,506,241, a dielectric resonator which has different characteristic impedance portions along its length. Specifically, the resonator includes a portion having a first characteristic impedance and another portion having a second characteristic impedance which is set different from the first-characteristic impedance, so that a characteristic impedance, ratio therebetween is set to a value other than one to prevent spurious resonance of the resonator at values corresponding to integral multiples of a fundamental resonance frequency.

Accordingly, there has been proposed and available a duplexer for a transmitter-receiver antenna, which includes the resonators of the type as described above. Specifically, the duplexer includes a transmission side band-pass filter and a reception side band-pass filter both of which are constituted by the same resonators, meaning that all the resonators have the same characteristic impedance ratio other than one.

However, the conventional duplexer as described above has the following drawbacks:

FIG. 12(A) is a graph showing a frequency characteristic of the transmission side band-pass filter, wherein the transmission side band-pass filter includes three resonators each having a characteristic impedance ratio K=0.6. As seen in FIG. 12(A), the spurious resonance frequency is shifted or deviated from a range A–B (around $3f_{ot}$ wherein $f_{ot}$ represents a fundamental resonance frequency of the transmission side band-pass filter) by means of the characteristic impedance ratio K being set to 0.6. As appreciated, as the characteristic impedance ratio K becomes smaller from one, the spurious resonance frequency increases from $3f_{ot}$.

On the other hand, FIG. 12(B) is a graph showing a frequency characteristic of the reception side band-pass filter, wherein the reception side band-pass filter includes three resonators each having a characteristic impedance ratio K=0.6, i.e. the same characteristic impedance ratio as that of each resonator in the transmission side band-pass filter. As seen in FIG. 12(B), the spurious resonance frequency is deviated from a range A–B (around $3f_{or}$ wherein $f_{or}$ represents a fundamental resonance frequency of the reception side band-pass filter), as in FIG. 12(A).

Accordingly, the independent frequency characteristics of the transmission and reception side band-pass filters are respectively improved.

However, when these band-pass filters are used in the duplexer, the following problem is raised.

As described above, the spurious resonance frequency of the reception side filter is deviated from the $3f_{or}$ band A–B, which, however, is now around the $3f_{ot}$ band A–B of the transmission side filter as seen in FIG. 12(B). As a result, as shown in FIG. 13, a spurious resonance band is broadly generated in the frequency characteristic of the transmission side filter, the generated spurious resonance band including the $3f_{ot}$ band A–B. This means that the reception side filter affects the frequency characteristic of the transmission side filter to generate the broad spurious resonance band including the $3f_{ot}$ band A–B. Accordingly, spurious or harmonic components of three times the fundamental resonance frequency $f_{ot}$ are largely included in transmission radio waves radiated from the antenna, which adversely affect other equipments as noises etc. In order to solve this problem, low-pass filters or the like still have to be additionally provided to eliminate those undesirable components so that reduction in size of the duplexer can not be realized.

Since the assigned communication frequency zones for transmission and reception are respectively set very narrow in a particular communication system, such as, the automobile telephone system and the portable telephone system, the above-described problem is very likely to happen when the characteristic impedance ratio K is set to a value other than one. This is further facilitated due to the fact that the characteristic impedance ratio K of each of the resonators of the transmission side filter is normally set to a value between 0.6 and 0.8 on a practical basis in view of a power loss in the transmission side filter which increases as the characteristic impedance ratio K-decreases from one.

No prior art teaches how to eliminate the above-described problem except for using the low-pass filters or the like.

SUMMARY OF THE INVENTION

Therefore, it is an object of the present invention to provide an improved filter device for a transmitter-receiver antenna that can eliminate one or more of the foregoing disadvantages inherent in the conventional filter device.

To accomplish the above-mentioned and other objects, according to one aspect of the present invention, a filter device for a transmitter-receiver antenna comprises a transmission side filter including a resonator having a first characteristic impedance ratio other than one; and a reception side filter including a resonator having a second characteristic impedance ratio, the second characteristic impedance ratio being set to a first value which prevents spurious resonance of the reception side filter at an integral multiple of a fundamental resonance frequency of the transmission side filter.

According to another aspect of the present invention, a filter device for a transmitter-receiver antenna comprises a transmission side filter including a plurality of resonators each having a first characteristic impedance ratio other than one, the first characteristic impedance ratio being the same for all the resonators of the transmission side filter; and a reception side filter including as many resonators as the resonators of the transmission side filter, each of the resonators of the reception side filter having a second characteristic impedance ratio which is the same for all resonators of the reception side filter, and the second characteristic impedance ratio being set to a first value which prevents spurious. resonance of the reception side filter at an integral multiple of a fundamental resonance frequency of the transmission side filter.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, preferred embodiments of the present invention will be described hereinbelow with reference to the accompanying drawings.

Figure 1:
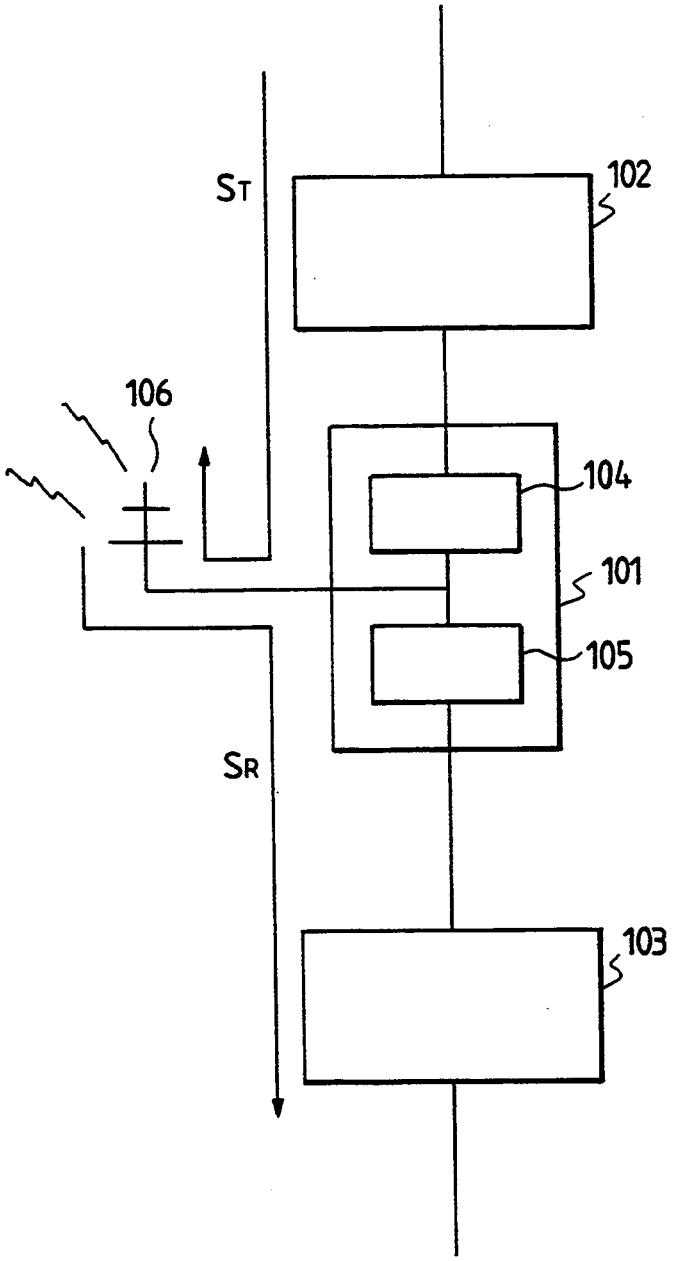
FIG. 1 is a block diagram schematically showing an antenna circuit including a filter device according to a first preferred embodiment of the present invention.

FIG. 1 is a block diagram schematically illustrating an antenna circuit for the automobile or portable telephone system, including a filter device, i.e. a duplexer according to a first preferred embodiment of the present invention. In FIG. 1, the filter device 101 is coupled between a transmitting circuit 102 and a receiving circuit 103. The filter device 101 comprises a transmission side band-pass filter 104 and a reception side band-pass filter 105, and a transmitter-receiver antenna 106 is connected between the transmission and reception side filters 104 and 105. A transmission signal is fed to the antenna 106 via the transmitting circuit 102 and the filter device 101 as indicated by an arrow $S_T$, to be radiated therefrom as a radio wave. On the other hand, a reception signal is fed to the receiving circuit 103 via the antenna 106 and the filter device 101 as indicated by an arrow $S_R$. This signal distribution manner itself is known in the art.

Now, the filter device 101 according to the first preferred embodiment will be described in detail with reference to FIGS. 2, 3 and 4(A), (B).

Figure 2:
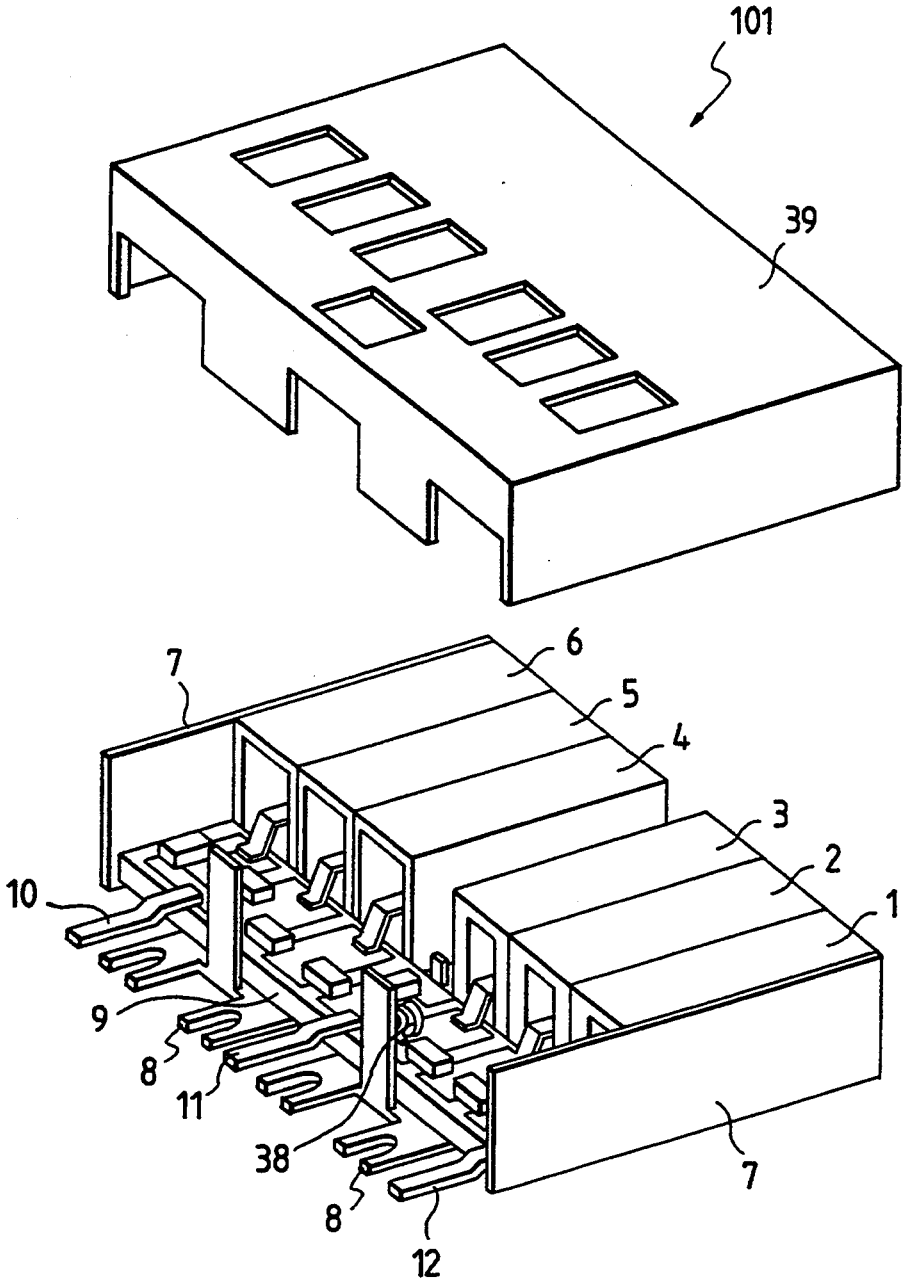
FIG. 2 is a perspective view showing the filter device according to the first preferred embodiment.
Figure 3:
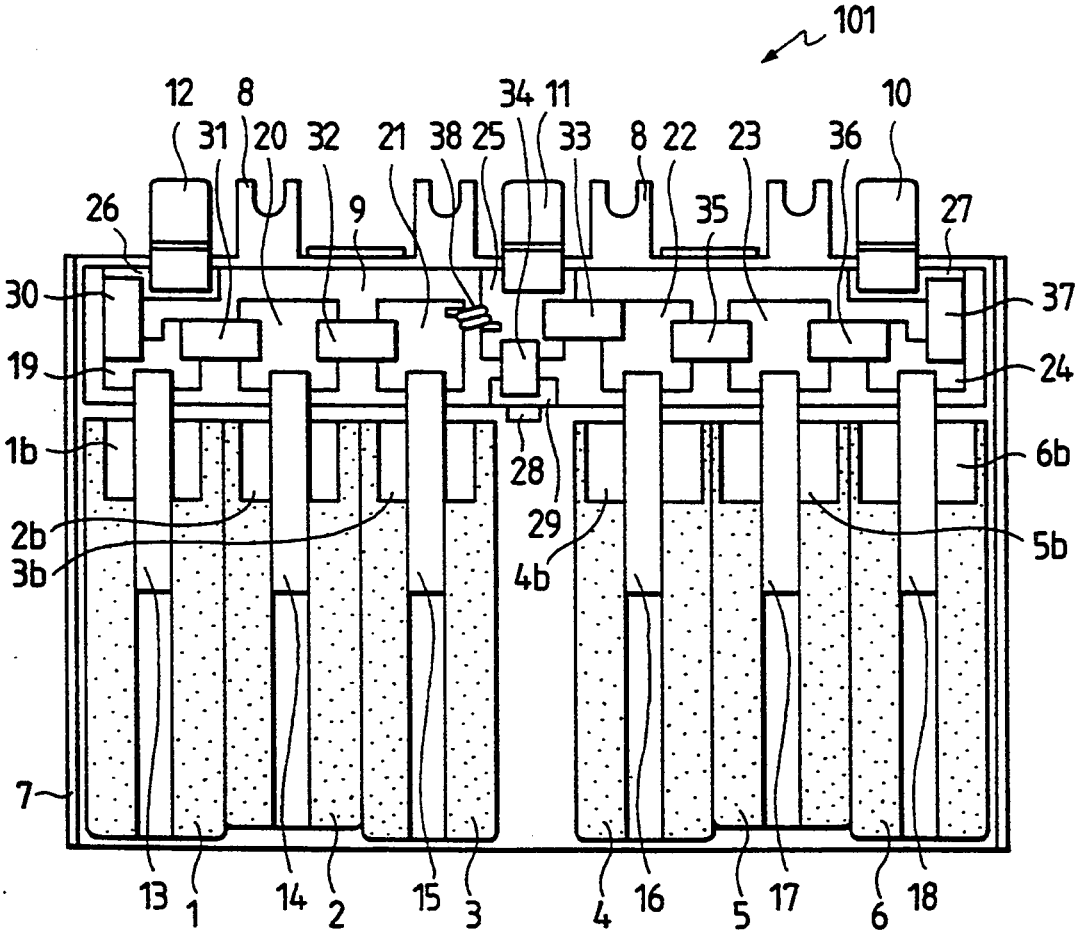
FIG. 3 is a sectional view showing the filter device according to the first preferred embodiment.

FIGS. 2 and 3 are perspective and sectional views, respectively, of the filter device 101. In FIGS. 2 and 3, numerals 1 to 6 respectively designate dielectric resonators, among which the resonators 1 to 3 cooperatively form the transmission side filter 104 and the resonators 4 to 6 cooperatively form the reception side filter 105.

Since the resonators 1 to 3 all have the same structure, the resonator 1 will be described with reference to FIGS. 4(A) and 4(B) which represents schematic perspective and sectional views, respectively, of the resonator 1. In FIGS. 4(A) and 4(B), a dielectric body 1*a* made of a dielectric material such as a ceramic material has a hollow rectangular parallelepiped shape with a stepped inner wall. The stepped inner wall is formed by a rectangular parallelepiped bore 1*b* having a square cross section and a cylindrical bore 1*c* having a circular cross section. The bores 1*b* and 1*c* are continuous with each other so as to form a through bore 1*d* in the dielectric body 1*a* along a length or an axis of the dielectric body 1*a* or the resonator 1. An outer conductive layer 1*e* is formed on the outer periphery of the dielectric body 1*a*, i.e. outer surfaces of the dielectric body 1*a* except for axially opposite end surfaces 1*h* and 1*i* where the bores 1*c* and 1*b* are respectively opened. On the other hand, an inner conductive layer 1*f* is formed on the stepped inner wall, i.e. the wall of the through bore 1*d*. Accordingly, the inner and outer conductive layers 1*f* and 1*e* are coaxially arranged with the dielectric body 1*a* interposed therebetween. A coupling conductive layer 1*g* is formed on the end surface 1*h* so as to make a short circuit between the inner and outer conductive layers. The other end surface 1*i* is exposed with no conductive layer thereon. The axial end of the resonator 1 with the coupling conductive layer 1*g* will be referred to as a short-circuit end, and the other axial end thereof will be referred to as an open end.

Now, explanation will be made to a characteristic impedance ratio K of the resonator 1 with reference to FIGS. 4(A) and 4(B).

The characteristic impedance ratio K is a ratio of a characteristic impedance $Z_1$ at a portion $A_1$ of the resonator 1 to a characteristic impedance $Z_2$ at a portion $A_2$ of the resonator 1. The characteristic impedances $Z_1$ and $Z_2$ are derived by the following equations, respectively:

$$Z_1=[60\times ln(b_2/b_1)]/(\epsilon r)^{\frac{1}{2}}$$

$$Z_2=[60\times ln(1.178\times b_2/a_1)]/(\epsilon r)^{\frac{1}{2}}$$

In these equations, $a_1$ represents a diameter of the cylindrical bore 1*c*, i.e. an outer diameter of the inner conductive layer 1*f* at the bore 1*c*, $b_1$ represents a length of a side of the square cross section of the bore 1b, i.e. a length of an outer side of a cross section of the inner conductive layer 1f at the bore 1b, $b_2$ represents a length of an outer side of a cross section of the dielectric body 1a (the cross section of the dielectric body 1a has four outer sides which all have the same length), i.e. a length of an inner side of a cross section of the outer conductive layer 1e, and $\epsilon r$ represents a dielectric constant of the dielectric body 1a.

The characteristic impedance ratio K is derived by the following equation:

$$K=Z_1/Z_2$$

Since $a_1$ is set smaller than $b_1$ in this preferred embodiment, the characteristic impedance ratio K is derived to be less than one ($0<K<1$).

Figure 4A:
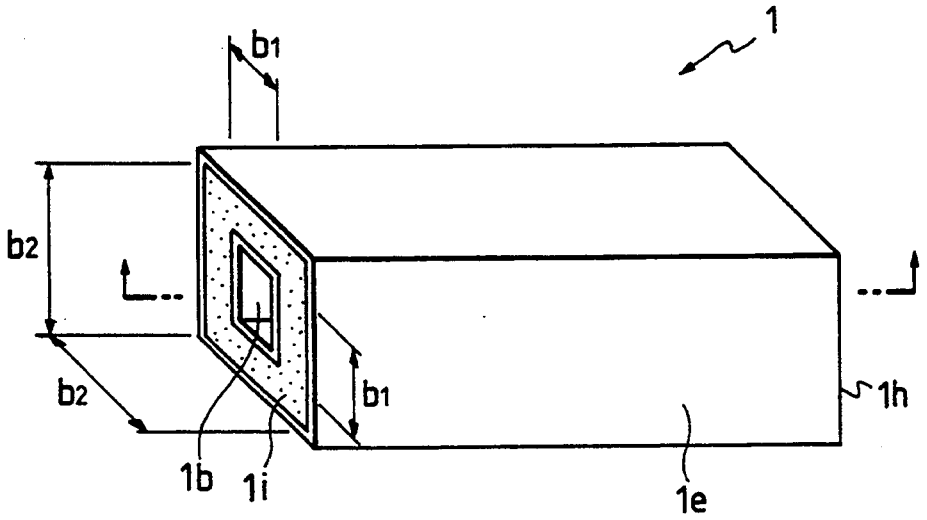
FIGS. 4(A) and 4(B) are perspective and sectional views, respectively, of a resonator for explaining a characteristic impedance ratio of the resonator.
Figure 4B:
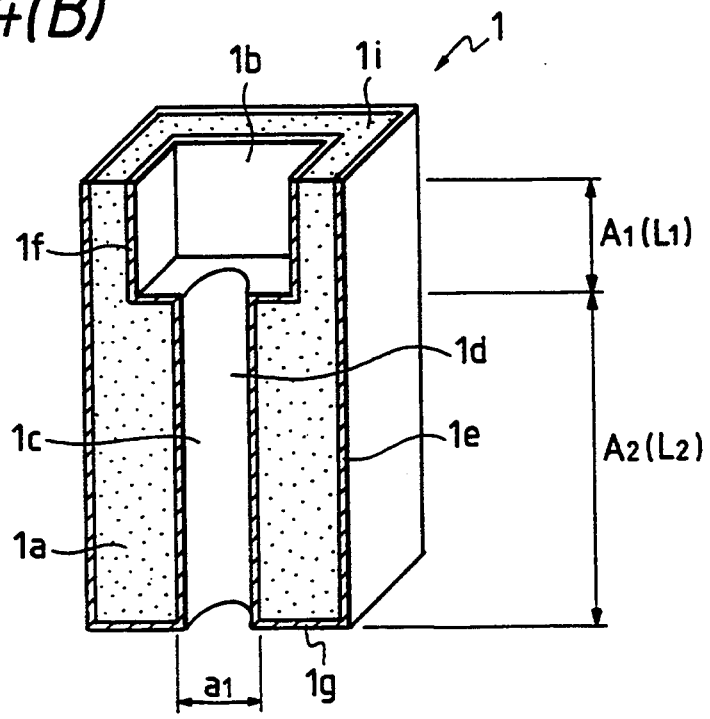

The resonator 1 is manufactured in the following manner:

The dielectric body la is first formed by forming powder of a dielectric material, such as, $BaO\text{-}TiO_2\text{-}Nd_2O_3$ into a given shape, such as, as shown in FIGS. 4(A) and 4(B), and then by sintering the shaped dielectric material. Subsequently, a conductive layer of a copper film having a thickness of about 5 μm is formed on the outer surfaces of and the stepped inner wall of the dielectric body 1a by the electroless plating or the electroplating. Finally, a portion of the conductive layer, i.e. the conductive layer at the foregoing open end 1i is removed to leave the inner, outer and coupling conductive layers 1f, 1e and 1g on the dielectric body 1a, thereby forming the resonator 1. The conductive layer may also be formed by painting, such as, silver paste on the dielectric body 1a and then by baking it.

Now, the resonators 4 to 6 will be described. Since the resonators 4 to 6 all have the same structure, the resonator 4 will be described hereinbelow.

The resonator 4 is manufactured in the same manner as the resonators 1 to 3 as described above. Further, the structure of the resonator 4 is the same as that of the resonator 1 except that a length corresponding to $b_1$ of the resonator 1 in FIGS. 4(A) and 4(B) is set greater than $b_1$ of the resonator 1, as clearly seen in FIGS. 2 and 3. Specifically, as shown in FIG. 3, the resonator 4 has a rectangular parallelepiped bore 4b with a square cross section, which corresponds to the rectangular parallelepiped bore 1b of the resonator 1. As described above, the bore 4b only differs from the bore 1b in that a length of a side of the square cross section of the bore 4b is set greater than the length $b_1$ of the bore 1b of the resonator 1.

Accordingly, in this preferred embodiment, a characteristic impedance $Z_1$ of the resonator 4, i.e. each of the resonators 4 to 6 is set smaller than the characteristic impedance $Z_1$ of the resonator 1, i.e. each of the resonators 1 to 3. On the other hand, a characteristic impedance $Z_2$ of the resonator 4 (5, 6) is set equal to the characteristic impedance $Z_2$ of the resonator 1 (2, 3). As a result, a characteristic impedance ratio K of the resonator 4 (5, 6) is set smaller than the characteristic impedance ratio K of the resonator 1 (2, 3).

For example, the following values may be set in the resonators 1 to 6:

| | |
|---|---|
| a length of an outer side of a cross section of each of the resonators 1 to 6: | 3.0 mm |
| an axial length of each of the resonators 1 to 6: | 8.0 mm |
| a thickness of the inner, outer and coupling conductive layers: | 5 μm |
| an axial length or depth of each of the bores 1b to 6b of the resonators 1 to 6: | 2.0 mm |
| a length of a side of a square cross section of each of the bores 1b to 3b of the resonators 1 to 3: | 2.0 mm |
| a length of a side of a square cross section of each of the bores 4b to 6b of the resonators 4 to 6: | 2.5 mm |

Referring back to FIGS. 2 and 3, the resonators 1 to 3 form the transmission side band-pass filter 104 and the resonators 4 to 6 form the reception side band-pass filter 105, as described above. Numeral 7 designates a metal chassis which is formed of such solder-plated phosphor bronze. The metal chassis 7 includes a bottom which is formed by bending the metal chassis 7. On the bottom of the metal chassis 7, the resonators 1 to 6 and a coupling board 9 are fixedly mounted. The coupling board 9 is formed by, such as, etching a double-side copper-coated printed board, The bottom of the metal chassis 7 is formed with fixing portions 8 by cutting and bending portions of the bottom of the metal chassis 7 The fixing portions 8 also work as grounding terminals. A reception side filter terminal 10, an antenna side terminal 11 and a transmission side filter terminal 12 are respectively coupled to the coupling board 9. Numerals 13 to 18 designate central conductors which are respectively coupled to the inner conductive layers of the resonators 1 to 6. These central conductors 13 to 18 are respectively formed by solder-plating a phosphor bronze plate having a thickness of about 0.15 mm. Numerals 19 to 24 designate electrodes formed on the coupling board 9, to which the central conductors 13 to 18 are respectively coupled. Numerals 25 to 27 designate electrodes formed on the coupling board 9, to which the antenna side terminal 11, the transmission side filter terminal 12 and the reception side filter terminal 10 are respectively coupled. A grounding terminal 28 is formed by lancing and bending a portion of the bottom of the metal chassis 7. The grounding terminal 28 is coupled to an electrode 29 formed on the coupling board 9. Numerals 30 to 37 designate chip capacitors which are respectively mounted on the coupling board 9. Specifically, the capacitor 30 is disposed between the electrodes 26 and 19, the capacitor 31 between the electrodes 19 and 20, the capacitor 32 between the electrodes 20 and 21, the capacitor 33 between the electrodes 22 and 25, the capacitor 34 between the electrodes 25 and 29, the capacitor 35 between the electrodes 22 and 23, the capacitor 36 between the electrodes 23 and 24, and the capacitor 37 between the electrodes 24 and 27. An air-core coil 38 is provided between the electrodes 21 and 25. A wire of the air-core coil 38 has a diameter of, for example, 0.3 mm. A cover 39 is further provided for protecting the components of the filter device 101, such as, the resonators 1 to 6 and the coupling board 9. The cover 39 is formed of, for example, solder-plated phosphor bronze.

The coupling relationship itself among the components as described above is known in the art.

Figure 5:
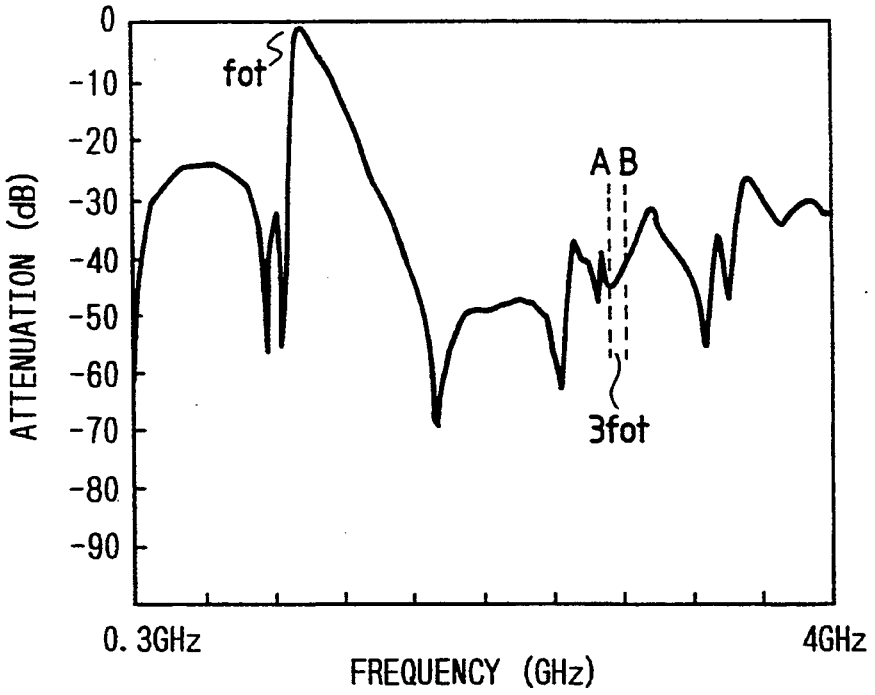
FIG. 5 is a graph showing a frequency characteristic of a transmission side filter of the filter device according to the first preferred embodiment.
Figure 12A:
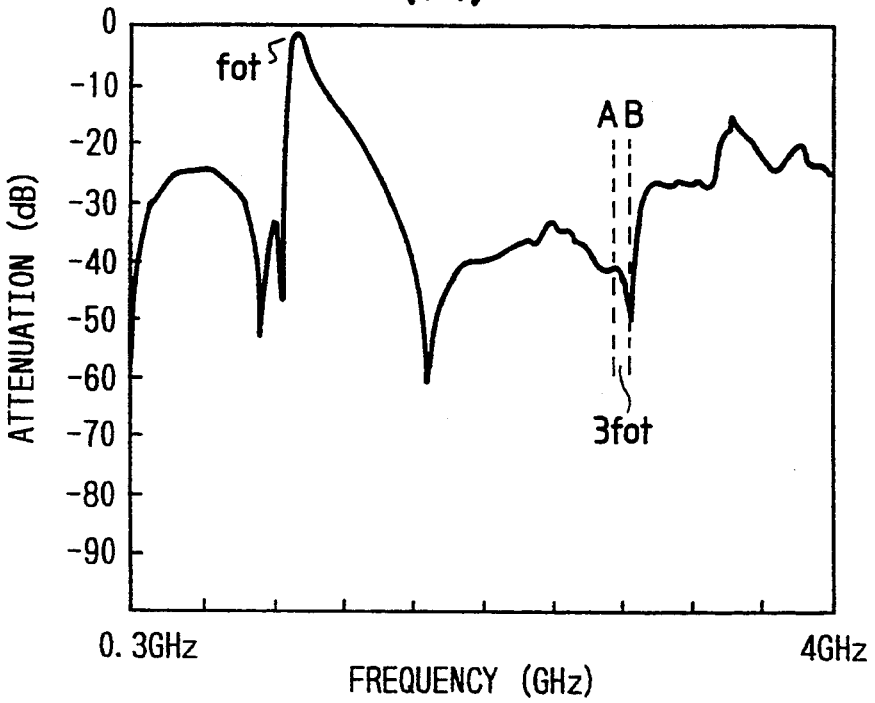
FIG. 12(A) PRIOR ART
FIGS. 12(A) and 12(B) are graphs respectively showing independent frequency characteristics of transmission and reception side filters of the prior art filter device.
Figure 12B:
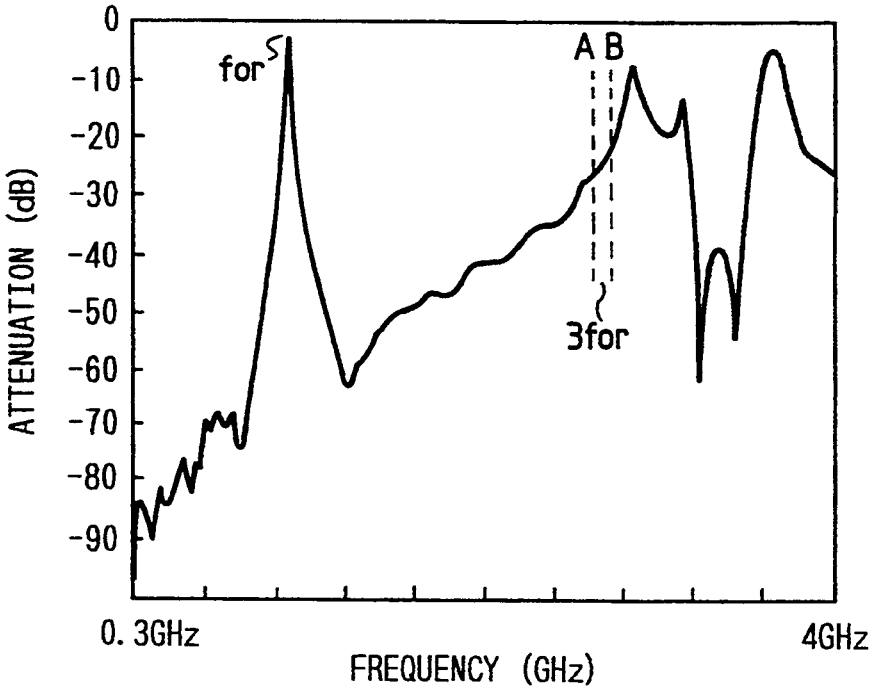
FIG. 12(B) PRIOR ART
Figure 13:
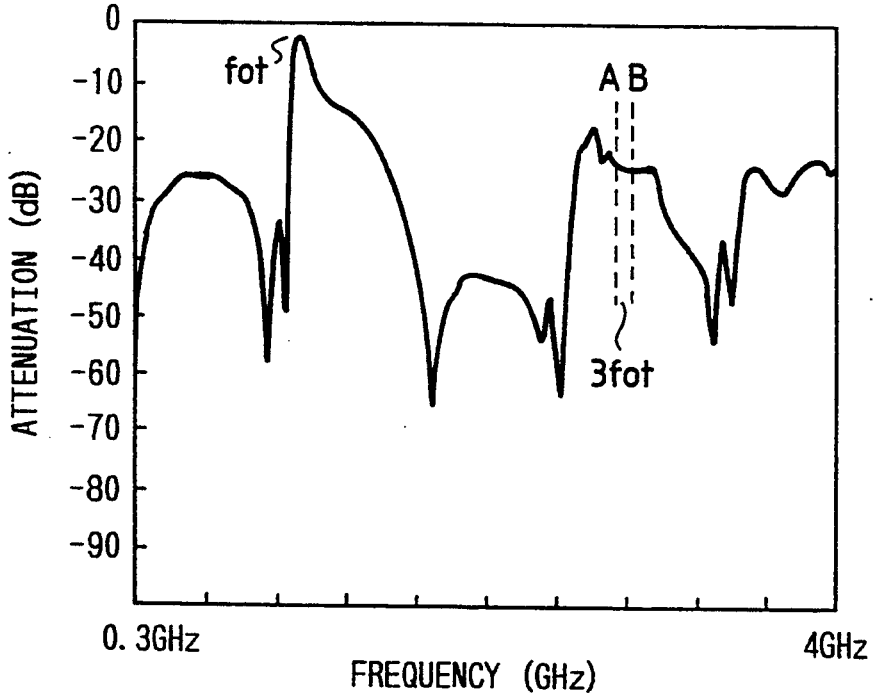
FIG. 13 PRIOR ART
FIG. 13 is a graph showing a frequency characteristic of the transmission side filter of the prior art filter device.

The filter device 101 according to the first preferred embodiment as described above has the following advantage over the conventional filter device:

FIG. 5 shows a frequency characteristic of the transmission side band-pass filter 104 of the filter device 101 according to the first preferred embodiment, wherein a characteristic impedance ratio K of each of the resonators 1 to 3 is set to 0.6 as in FIG. 12(A), while a characteristic impedance ratio K of each of the resonators 4 to 6 is set to 0.3. As seen in FIG. 5, the spurious components at the $3f_{ot}$ band A–B is significantly attenuated in comparison with FIG. 13 which shows the frequency characteristic of the transmission side filter of the conventional filter device.

Accordingly, when the spurious resonance is generated in the transmission side filter 104 around integral multiples of the fundamental resonance frequency $f_{ot}$, particularly at the $3f_{ot}$ band A–B with the transmission side resonators 1 to 3 and the reception side resonators 4 to 6 having the same characteristic impedance ratio K which is set other than one, the spurious components at the $3f_{ot}$ band A–B can be largely attenuated as shown in FIG. 5 by setting the characteristic impedance ratio K of the reception side resonators 4 to 6 to be different from that of the transmission side resonators 1 to 3, i.e. smaller than that of the transmission side resonators 1 to 3 in this preferred embodiment.

Figure 6:
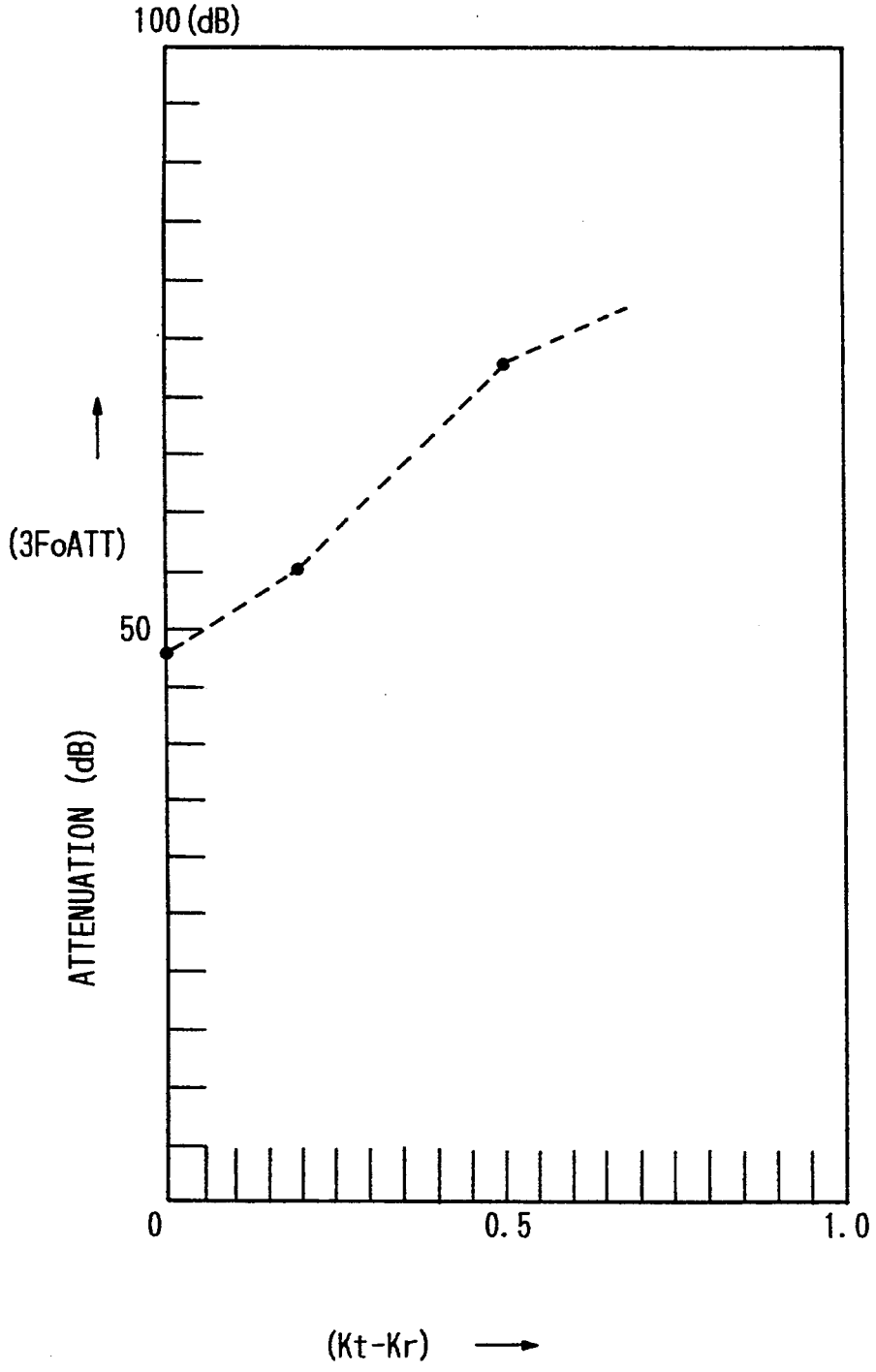
FIG. 6 is a graph showing a relationship between a differential between characteristic impedance ratios of transmission and reception side resonators and an attenuation of spurious components at a $3f_{ot}$ band, wherein the characteristic impedance ratio of the reception side resonator is set smaller than that of the transmission side resonator.

FIG. 6 shows this effect in more detail. FIG. 6 is a graph showing a relationship between a differential (Kt−Kr) between a characteristic impedance ratio Kt of the transmission side resonators 1 to 3 and a characteristic impedance ratio Kr of the reception side resonators 4 to 6 and an attenuation 3FoAtt of the spurious components at the $3f_{ot}$ band A–B, according to the first preferred embodiment. In FIG. 6, the characteristic impedance ratio Kt of the transmission side resonators 1 to 3 is fixed to 0.8. When Kt=Kr as in the conventional device, the attenuation 3FoAtt is 48.2 dB. On the other hand, when the characteristic impedance ratio Kr is set smaller to provide Kt−Kr=0.2, the attenuation 3FoAtt becomes 54.2 dB. Further, when Kt−Kr=0.5, the attenuation 3FoAtt becomes 72.4 dB.

As appreciated from the foregoing description, according to the first preferred embodiment, by setting the differential (Kt−Kr) to be larger, the attenuation 3FoAtt becomes larger so that the spurious components around integral multiples of the fundamental resonance frequency $f_{ot}$, particularly at the $3f_{ot}$ band A–B can be largely removed from the radio wave radiated from the antenna 106.

This means that the spurious components at the $3f_{ot}$ band A–B can be attenuated in the frequency characteristic of the transmission side filter 104 by deviating the characteristic impedance ratio Kr of the reception side resonators 4 to 6 from a value Rs which causes the spurious resonance of the reception side band-pass filter 105 at the $3f_{ot}$ band A–B of the transmission side filter 104. The attenuation 3FoAtt increases as the deviation of Kr from the value Rs increases. As referred to in the description of the prior art, since the characteristic impedance ratio Kt of the transmission side resonator is normally set to a value between 0.6 and 0.8 in view of the power loss, the value Rs is likely to correspond to the characteristic impedance ratio Kt of the transmission side resonator.

In general, it is preferable that the differential (Kt−Kr) or (Rs−Kr) is set equal to or greater than 0.2.

Figure 7:
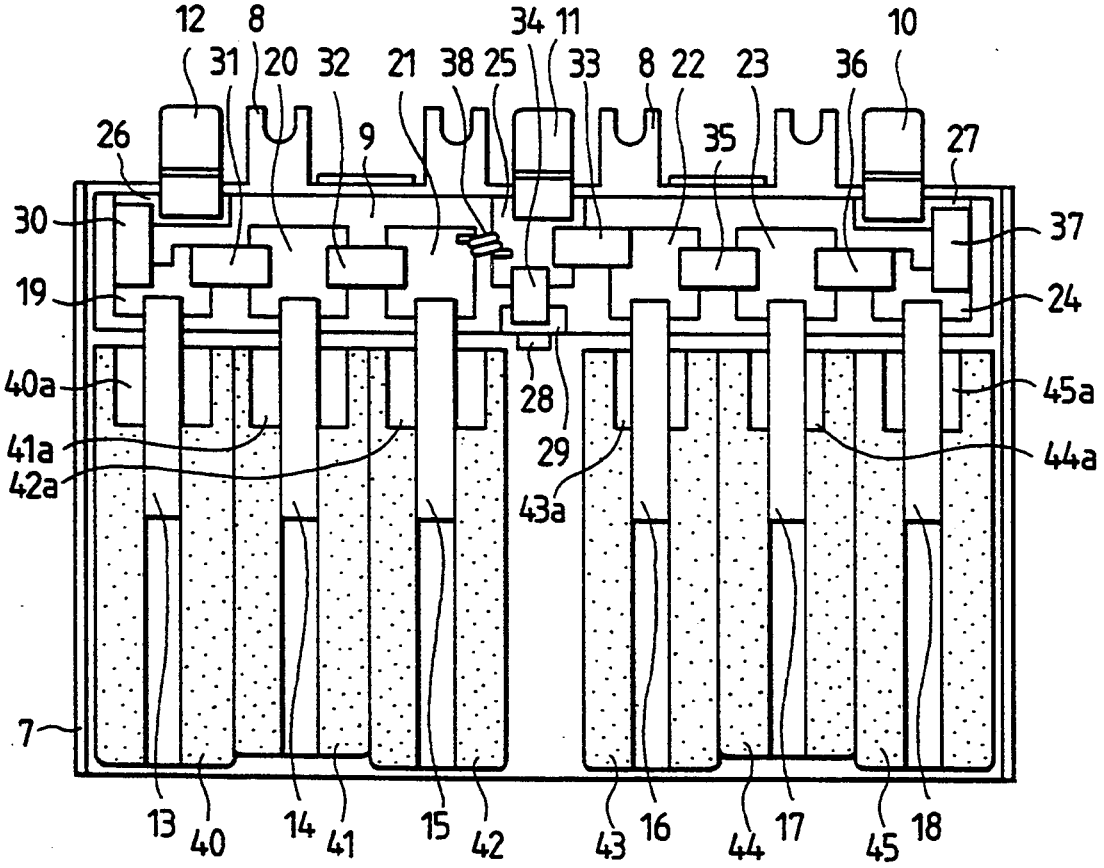
FIG. 7 is a sectional view showing a filter device according to a second preferred embodiment of the present invention.

Now, a second preferred embodiment of the present invention will be described hereinbelow with reference to FIG. 7. The second preferred embodiment has the same structure as the first preferred embodiment except for a dimensional relationship between rectangular parallelepiped bores 40*a*, 41*a*, 42*a* of transmission side resonators 40 to 42 corresponding to the bores 1*b*, 2*b*, 3*b* of the transmission side resonators 1 to 3 and rectangular parallelepiped bores 43*a*, 44*a*, 45*a* of reception side resonators 43 to 45 corresponding to the bores 4*b*, 5*b*, 6*b* of the reception side resonators 4 to 6. Specifically, in the second preferred embodiment, a length of a side of a square cross section of each of the bores 43*a* to 45*a* is set smaller than that of each of the bores 40*a* to 42*a*. The resonators 40 to 42 all have the same structure, and the resonators 43 to 45 all have the same structure.

Accordingly, in the second preferred embodiment, a characteristic impedance $Z_1$ of each of the resonators 43 to 45 is set greater than a characteristic impedance $Z_1$ of each of the resonators 40 to 42. On the other hand, a characteristic impedance $Z_2$ of each of the resonators 43 to 45 is set equal to a characteristic impedance $Z_2$ of each of the resonators 40 to 42, as in the first preferred embodiment. As a result, a characteristic impedance ratio K of the resonator 43 (44, 45) is set greater than a characteristic impedance ratio K of the resonator 40 (41, 42).

For example, the following values may be set in the resonators

| | |
|---|---|
| a length of an outer side of a cross section of each of the resonators 40 to 45: | 3.0 mm |
| an axial length of each of the resonators 40 to 45: | 8.0 mm |
| a thickness of the inner, outer and coupling conductive layers: | 5 μm |
| an axial length or depth of each of the bores 40a to 45a of the resonators 40 to 45: | 2.0 mm |
| a length of a side of a square cross section of each of the bores 40a to 42a of the resonators 40 to 42: | 2.0 mm |
| a length of a side of a square cross section of each of the bores 43a to 45a of the resonators 43 to 45: | 1.4 mm |

Figure 8:
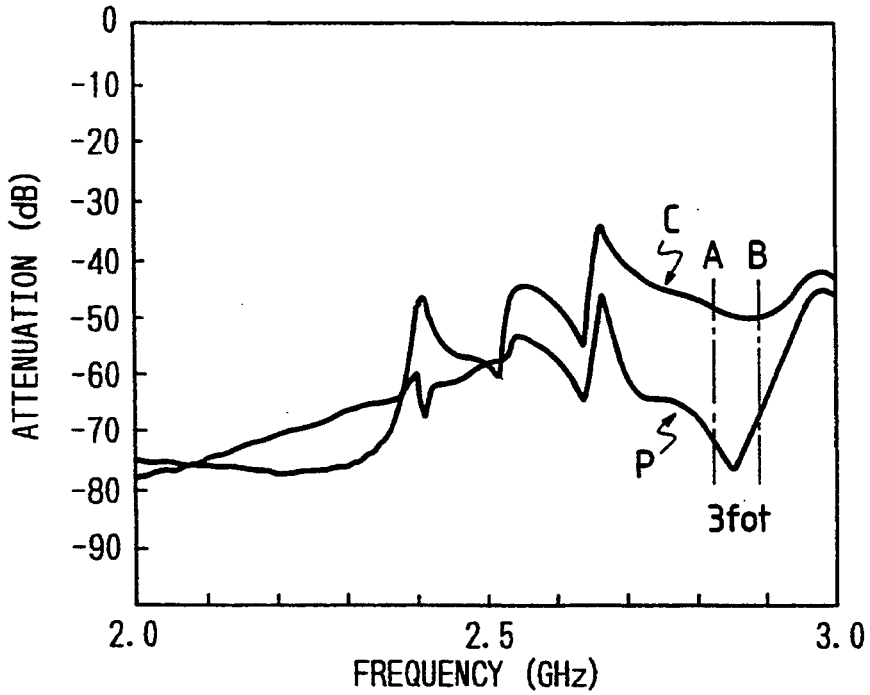
FIG. 8 is a graph showing a relationship between frequency characteristics of a transmission side filter of the filter device according to the second preferred embodiment and a transmission side filter of a prior art filter device.

The filter device 101 according to the second preferred embodiment has the following advantage over the conventional filter device:

FIG. 8 is a graph showing a relationship between a frequency characteristic, represented by P, of the transmission side band-pass filter 104 of the filter device 101 according to the second preferred embodiment and a frequency characteristic, represented by C, of the transmission side band-pass filter of the conventional filter device. The frequency characteristic P is derived by setting a characteristic impedance ratio K of each of the transmission side resonators 40 to 42 to 0.65, and a characteristic impedance ratio K of each of the reception side resonators 43 to 45 to 0.85. On the other hand, the frequency characteristic C is derived by setting a characteristic impedance ratio K of each of the transmission and reception side resonators to 0.65. As seen in FIG. 8, the frequency characteristic P according to the second preferred embodiment is improved on the whole in comparison with the frequency characteristic C of the conventional filter device, particularly at the $3f_{ot}$ band A–B where the spurious components are significantly attenuated.

Accordingly, when the spurious resonance is generated in the transmission side filter around integral multiples of the fundamental resonance frequency $f_{ot}$ band A–B with the transmission side resonators 40 to 42 and the reception side resonators 43 to 45 having the same characteristic impedance ratio K which is set other than one, the spurious components at the $3f_{ot}$ band A–B can be largely attenuated as shown in FIG. 8 by setting the characteristic impedance ratio K of the reception side resonators 43 to 45 to be different from that of the transmission side resonators 40 to 42, i.e. greater than that of the transmission side resonators 40 to 42 in the second preferred embodiment.

Figure 9:
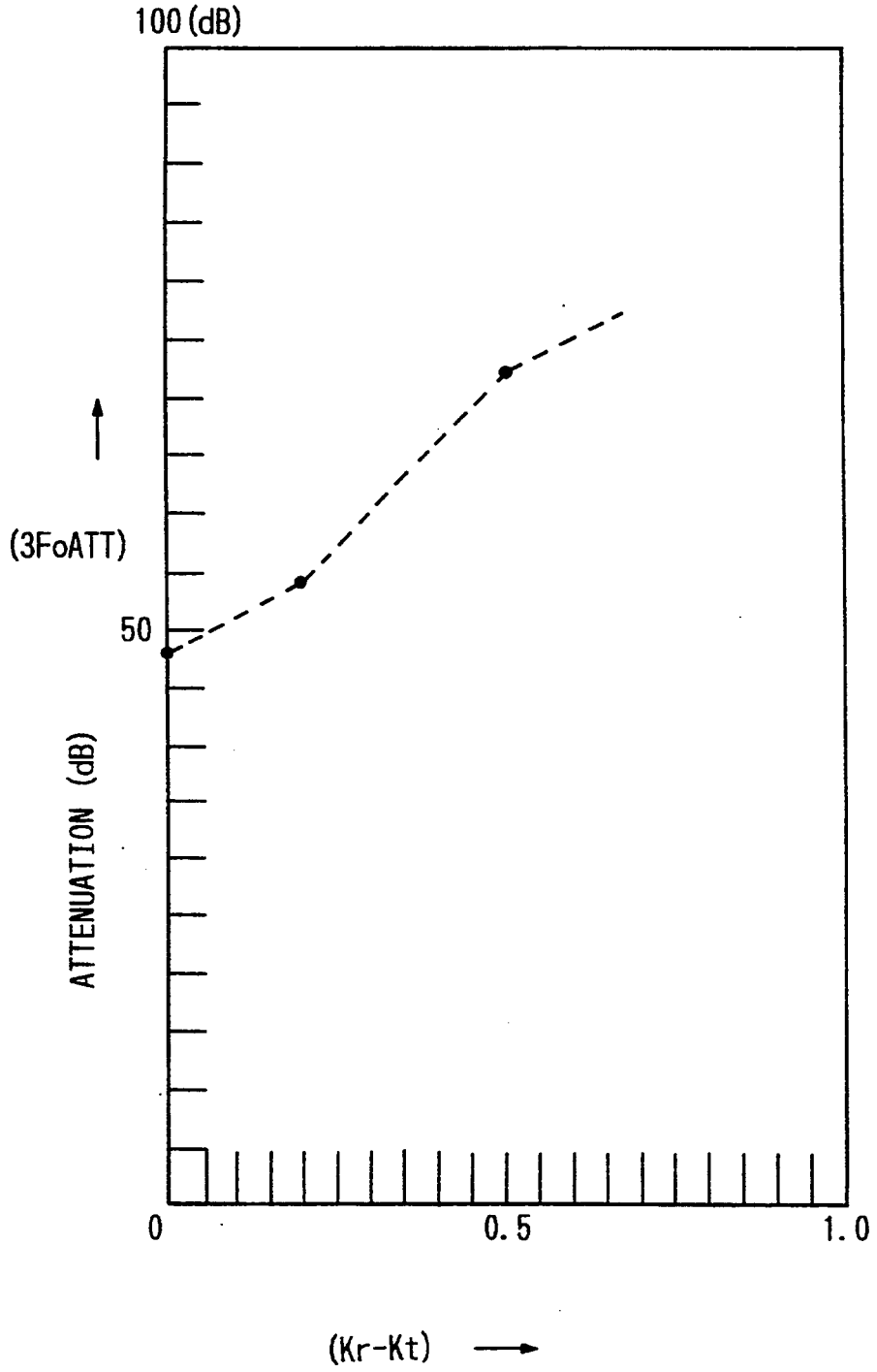
FIG. 9 is a graph showing a relationship between a differential between characteristic impedance ratios of transmission and reception side resonators and an attenuation of spurious components at a $3f_{ot}$ band, wherein the characteristic impedance ratio of the reception side resonator is set greater than that of the transmission side resonator.

FIG. 9 shows this effect in more detail. FIG. 9 is a graph showing a relationship between a differential (Kr−Kt) between a characteristic impedance ratio Kt of the transmission side resonators 40 to 42 and a characteristic impedance ratio Kr of the reception side resonators 43 to 45 and an attenuation 3FoAtt of the spurious components at the $3f_{ot}$ band A–B, according to the second preferred embodiment. In FIG. 9, the characteristic impedance ratio Kt of the transmission side resonators 40 to 42 is fixed to 0.8. When Kt=Kr as in the conventional filter device, the attenuation 3FoAtt is 48.2 dB. On the other hand, when the characteristic impedance ratio Kr is set greater to provide Kr−Kt=0.2, the attenuation 3FoAtt becomes 53.3 dB. Further, when Kr−Kt=0.5, the attenuation 3FoAtt becomes 71.5 dB.

As appreciated from the foregoing description, according the second preferred embodiment, by setting the differential (Kr−Kt) to be larger, the attenuation 3FoAtt becomes larger so that the spurious components around integral multiples of the fundamental resonance frequency $f_{ot}$, particularly at the $3f_{ot}$ band A–B can be largely removed from the radio wave radiated from the antenna 106.

As described in the first preferred embodiment, this means that the spurious components at the $3f_{ot}$ band A–B can be attenuated in the frequency characteristic of the transmission side band-pass filter 104 by deviating the characteristic impedance ratio Kr of the reception side resonators 43 to 45 from a value Rs which causes spurious resonance of the reception side band-pass filter 105 at the $3f_{ot}$ band A–B. The attenuation 3FoAtt increases as the deviation of Kr from the value Rs increases.

In general, it is preferable that the differential (Kr−Kt) or Kr−Rs) is set equal to or greater than 0.2.

Figure 10:
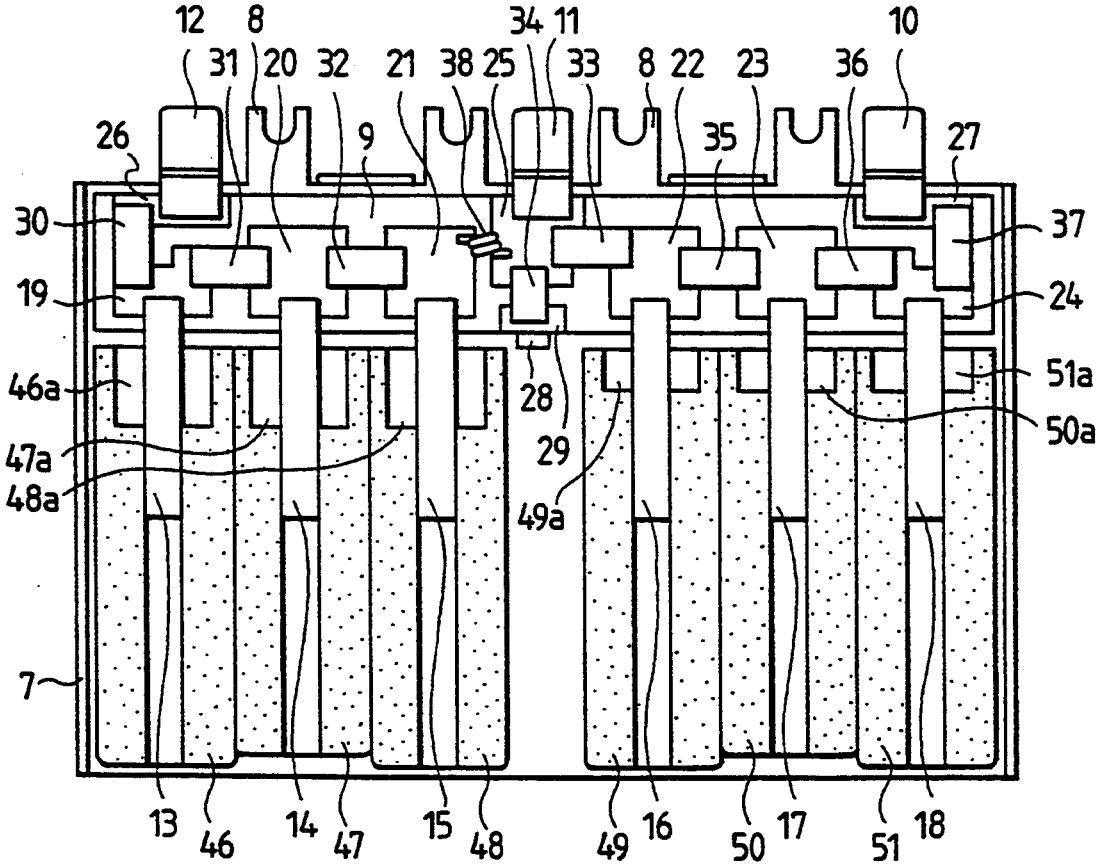
FIG. 10 is a sectional view showing a filter device according to a third preferred embodiment of the present invention.

Now, a third preferred embodiment of the present invention will be described hereinbelow with reference to FIG. 10. The third preferred embodiment has the same structure as the first preferred embodiment except for a dimensional relationship between rectangular parallelepiped bores 46*a*, 47*a*, 48*a* of transmission side resonators 46 to 48 corresponding to the bores 1*b*, 2*b*, 3*b* of the transmission side resonators 1 to 3 and rectangular parallelepiped bores 49*a*, 50*a*, 51*a* of reception side resonators 49 to 51 corresponding to the bores 4*b*, 5*b*, 6*b* of the reception side resonators 4 to 6. Specifically, in the third preferred embodiment, an axial length or depth of each of the bores 49*a* to 51*a* is set smaller than that of each of the bores 46*a* to 48*a*, while a length of a side of a square cross section of each of the bores 49*a* to 51*a* is set equal to that of each of the bores 46*a* to 48*a*. The resonators 46 to 48 all have the same structure, and the resonators 49 to 51 all have the same structure.

In the third preferred embodiment, a characteristic impedance ratio K is derived by the following equation:

$$K=(\tan \beta L_1)\times(\tan \beta L_2)(L_2 \geqq L_1)$$

wherein, $L_1$ represents an axial length of the portion $A_1$ of the resonator in FIG. 4(B), $L_2$ represents an axial length of the portion $A_2$ of the resonator in FIG. 4(B), and $\beta$ represents a phase constant and derived by $\beta=(\epsilon r)^{\frac{1}{2}}\times 2\pi/\lambda_o$, wherein $\epsilon r$ represents a dielectric constant of the dielectric body 1*a* in FIG. 4(B) and $\lambda_o$ represents a resonance wavelength in the vacuum.

Accordingly, in the third preferred embodiment, a characteristic impedance ratio K of each of the reception side resonators 49 to 51 is set greater than a characteristic impedance ratio K of each of the transmission side resonators 46 to 48, as in the second preferred embodiment.

For example,-the following values may be set in the resonators 46 to 51 according to the third preferred embodiment:

| | |
|---|---|
| a length of an outer side of a cross section of each of the resonators 46 to 51: | 3.0 mm |
| an axial length of each of the resonators 46 to 51: | 8.0 mm |
| a thickness of the inner, outer and coupling conductive layers: | 5 μm |
| an axial length or depth of each of the bores 46a to 48a of the resonators 46 to 48: | 2.0 mm |
| an axial length or depth of each of the bores 49a to 51a of the resonators 49 to 51: | 1.0 mm |
| a length of a side of a square cross section of each of the bores 46a to 51a of the resonators 46 to 51: | 2.0 mm |

The third preferred embodiment works to provide effects similar to those in the second preferred embodiment.

Figure 11:
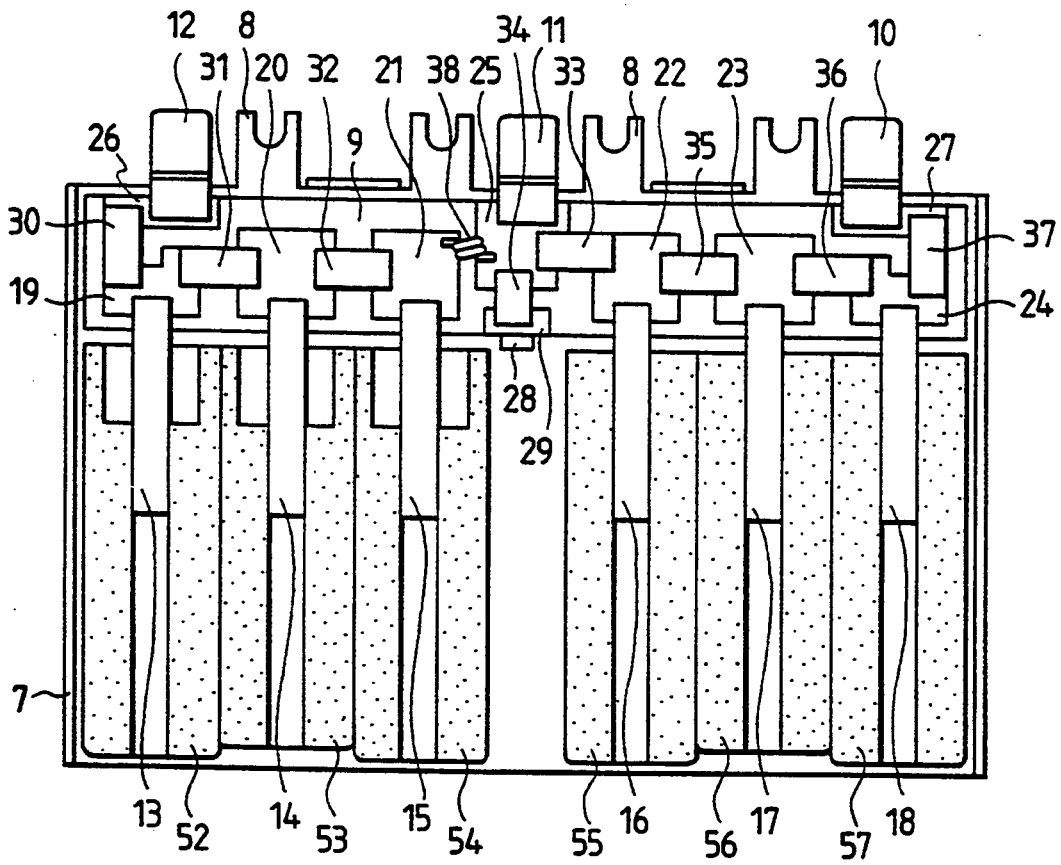
FIG. 11 is a sectional view showing a modification of the second or third preferred embodiment.

FIG. 11 shows a modification of the second and third preferred embodiments, wherein each of reception side resonators 55 to 57 has no stepped inner wall. Specifically, a cylindrical axial through bore formed in each of the resonators 55 to 57 has no stepped shape so that a diameter of the cylindrical axial through bore is constant all along its length. This means that a characteristic impedance ratio K of each of the resonators 55 to 57 is set to one. On the other hand, transmission side resonators 52 to 54 have the same structure as the transmission side resonators 40 to 42 or 46 to 48 in the second or third preferred embodiment. Accordingly, in the modification of FIG. 11, a characteristic impedance ratio K of each of the reception side resonators 55 to 57 is set greater than that of each of the transmission side resonators 52 to 54 as in the second or third preferred embodiment.

According to this modification, although the reception side filter has its own frequency characteristic in which the spurious resonance is generated at the $3f_{or}$ band A–B, the transmission side filter is prevented from generating the spurious resonance at the $3f_{ot}$ band A–B being affected by the frequency characteristic of the reception side filter. Accordingly, only in view of suppressing the spurious resonance at the $3f_{ot}$ band A–B in the frequency characteristic of the transmission side filter, this modification can also effectively work.

It is to be understood that this invention is not to be limited to the preferred embodiments and modifications described above, and that various changes and modifications may be made without departing from the spirit and scope of the invention as defined in the appended claims.

For example, the characteristic impedance ratio K of each of the reception side resonators may be set by changing both the length of the side of the square cross section of the rectangular parallelepiped bore and the axial length or depth thereof relative to those of the transmission side resonators.

What is claimed is:

1. A filter device for a transmitter-receiver antenna, comprising:

a transmission side filter including a coaxial dielectric resonator having a first characteristic impedance ratio other than one;

a reception side filter including a coaxial dielectric resonator having a second different, characteristic impedance ratio; and said second characteristic impedance ratio being set to a first value which prevents spurious resonance of said reception side filter at an integral multiple of a fundamental resonance frequency of said transmission side filter;

wherein each of said resonators has an open-circuit end and a short-circuit end axially opposite to said open-circuit end, each of said resonators having a first characteristic impedance at a side of said resonator with said open-circuit end and a second characteristic impedance at a side of said resonator with said short-circuit end, and each of said first and second characteristic impedance ratios is derived by dividing said first characteristic impedance by said second characteristic impedance.

2. The filter device as set forth in claim 1, wherein said first characteristic impedance ratio being set at a second value, said first value is set smaller than the second value by equal to or more than 0.2, said second value generating the spurious resonance of said reception side filter at the integral multiple of the fundamental resonance frequency of said transmission side filter.

3. The filter device as set forth in claim 1, wherein said first characteristic impedance ratio being at a second value, said first value is greater than the second value by equal to or more than 0.2, said second value generating the spurious resonance of said reception side filter at the integral multiple of the fundamental resonance frequency of said transmission side filter.

4. The filter device as set forth in claim 1, wherein said first value is smaller than said first characteristic impedance ratio.

5. The filter device as set forth in claim 1, wherein said first value is greater than said first characteristic impedance ratio.

6. The filter device as set forth in claim 1, wherein each of said resonators has a stepped bore which is opened at said open-circuit end and said short-circuit end so as to provide said first and second characteristic impedances.

7. A filter device for a transmitter-receiver antenna, comprising:

a transmission side filter including a coaxial dielectric resonator having a first characteristic impedance ratio other than one;

a reception side filter including a coaxial dielectric resonator having a second characteristic impedance ratio; and said second characteristic impedance ratio being set to a first value which prevents spurious resonance of said reception side filter at an integral multiple of a fundamental resonance frequency of said transmission side filter;

wherein (i) each of said resonators has an open-circuit end and a short-circuit end axially opposite to said open-circuit end, each of said resonators having a first characteristic impedance at a side of said resonator with said open-circuit end and a second characteristic impedance at a side of said resonator with said short-circuit end, and each of said first and second characteristic impedance ratios is derived by dividing said first characteristic impedance by said second characteristic impedance, (ii) said first value is set smaller than said first characteristic impedance ratio, (iii) each of said resonators includes a dielectric body having a stepped inner wall defined by a stepped bore formed through said resonator, (iv) an inner conductor is attached to said stepped inner wall of the dielectric body, an outer conductor is attached to an outer periphery of said dielectric body, and a short-circuit conductor is attached to one end of said dielectric body for making a short circuit between said inner and outer conductors, (v) said stepped bore includes a first bore and a second bore with a step therebetween, said first bore being opened at said one end of the dielectric body and said second bore being opened at an end of said dielectric body opposite to said one end, and (vi) said first value is set smaller than said first characteristic impedance ratio by setting a cross-sectional area of said second bore of the resonator of the reception side filter to be greater than that of the second bore of the resonator of the transmission side filter.

8. A filter device for a transmitter-receiver antenna, comprising:

a transmission side filter including a coaxial dielectric resonator having a first characteristic impedance ratio other than one;.

a reception side filter including a coaxial dielectric resonator having a second characteristic impedance ratio; and said second characteristic impedance ratio being set to a first value which prevents spurious resonance of said reception side filter at an integral multiple of a fundamental resonance frequency of said transmission side filter;

wherein (i) each of said resonators has an open-circuit end and a short-circuit end axially opposite to said open-circuit end, each of said resonators having a first characteristic impedance at a side of said resonator with said open-circuit end and a second characteristic impedance at a side of said resonator with said short-circuit end, and each of said first and second characteristic impedance ratios is derived by dividing said first characteristic impedance by said second characteristic impedance, (ii) said first value is set greater than said first characteristic impedance ratio, (iii) each of said resonators includes a dielectric body having a stepped inner wall defined by a stepped bore formed through said resonator, (iv) an inner conductor is attached to said stepped inner wall of the dielectric body, an outer conductor is attached to an outer periphery of said dielectric body, and a short-circuit conductor is attached to one end of said dielectric body for making a short circuit between said inner and outer conductors, (v) said stepped bore includes a first bore and a second bore with a step therebetween, said first bore being opened at said one end of the dielectric body and said second bore being opened at an end of said dielectric body opposite to said one end, and (vi) said first value is set greater than said first characteristic impedance ratio by setting a cross-sectional area of said second bore of the resonator of the reception side filter to be smaller than that of the second bore of the resonator of the transmission side filter.

9. A filter device for a transmitter-receiver antenna, comprising:

a transmission side filter including a coaxial dielectric resonator having a first characteristic impedance ratio other than one;

a reception side filter including a coaxial dielectric resonator having a second characteristic impedance ratio; and said second characteristic impedance ratio being set to a first value which prevents spurious resonance of said reception side filter at an integral multiple of a fundamental resonance frequency of said transmission side filter;

wherein (i) each of said resonators has an open-circuit end and a short-circuit end axially Opposite to said open-circuit end, each of said resonators having a first characteristic impedance at a side of said resonator with said open-circuit end and a second characteristic impedance at a side of said resonator with said short-circuit end, and each of said first and second characteristic impedance ratios is derived by dividing said first characteristic impedance by said second characteristic impedance, (ii) said first value is set greater than said first characteristic impedance ratio, (iii) each of said resonators includes a dielectric body having a stepped inner wall defined by a stepped bore formed through said resonator, (iv) an inner conductor is attached to said stepped inner wall of the dielectric body, an outer conductor is attached to an outer periphery of said dielectric body, and a short-circuit conductor is attached to one end of said dielectric body for making a short circuit between said inner and outer conductors, (v) said stepped bore includes a first bore and a second bore with a step therebetween, said first bore being opened at said one end of the dielectric body and said second bore being opened at an end of said dielectric body opposite to said one end, and (vi) said first value is set greater than said first characteristic impedance ratio by setting a depth of said second bore of the resonator of the reception side filter to be smaller than that of the second bore of the resonator of the transmission side filter.

10. A filter device for a transmitter-receiver antenna, comprising:

a transmission side filter including a plurality of coaxial dielectric resonators each having a first characteristic impedance ratio other than one, said first characteristic impedance ratio being the same for all the resonators of said transmission side filter;

a reception side filter including as many coaxial dielectric resonators as the resonators of said transmission side filter, each of the resonators of said reception side filter having a second, different, characteristic impedance ratio which is the same for all the resonators of the reception side filter; and said second characteristic impedance ratio being set to a first value which prevents spurious resonance of said reception side filter at an integral multiple of a fundamental resonance frequency of said transmission filter;

wherein each of said resonators has an open-circuit end and a short-circuit end axially opposite to said open-circuit end, each of said resonators having a first characteristic impedance at a side of said resonator with said open-circuit end and a second characteristic impedance at a side of said resonator with said short-circuit end, and each of said first and second characteristic impedance ratios is derived by dividing said first characteristic impedance by said second characteristic impedance.

11. A filter device as set forth in claim 10, wherein said first characteristic impedance ratio being set at a second value, said first value is set smaller than the second value by equal to or more than 0.2, said second value generating the spurious resonance of said reception side filter at the integral multiple of the fundamental resonance frequency of said transmission side filter.

12. A filter device as set forth in claim 10, wherein said first characteristic impedance ratio being set at a second value, said first value is set greater than the second value by equal to or more than 0.2, said second value generating the spurious resonance of said reception side filter at the integral multiple of the fundamental resonance frequency of said transmission side filter.

13. The filter device as set forth in claim 10, wherein said first value is smaller than said first characteristic impedance ratio.

14. The filter device as set forth in claim 10, wherein said first value is greater than said first characteristic impedance ratio.

15. The filter device as set forth in claim 10, wherein each of said resonators has a stepped bore which is opened at said open-circuit end and said short-circuit end so as to provide said first and second characteristic impedances.

16. A filter device for a transmitter-receiver antenna, comprising:

a transmission side filter including a coaxial dielectric resonator having a first characteristic impedance ratio other than one;

a reception side filter including a coaxial dielectric resonator having a second, different, characteristic impedance ratio; and said second characteristic impedance ratio being set to a first value which prevents spurious resonance of said reception side filter at an integral multiple of a fundamental resonance frequency of said transmission side filter;

wherein each of said resonators has an open-circuit end and a short-circuit end axially opposite to said open-circuit end, each of said resonators having a bore which is opened at said open-circuit end and said short-circuit end, said bore having a first portion, at a side of said resonator with said open-circuit end, with a first cross sectional area to provide a first characteristic impedance of the resonator and a second portion, at a side of said resonator with said short-circuit end, with a second cross sectional area different from said first cross sectional area to provide a second characteristic impedance of the resonator, and each of said first and second characteristic impedance ratios is derived by dividing said first characteristic impedance by said second characteristic impedance.

17. A filter device for a transmitter-receiver antenna, comprising:

a transmission side filter including a plurality of coaxial dielectric resonators each having a first characteristic impedance ratio other than one, said first characteristic impedance ratio being the same for all the resonators of said transmission side filter;

a reception side filter including as many coaxial dielectric resonators as the resonators of said transmission side filter, each of the resonators of said reception side filter having a second, different, characteristic impedance ratio which is the same for all the resonators of the reception side filter; and said second characteristic impedance ratio being set to a first value which prevents spurious resonance of said reception side filter at an integral multiple of a fundamental resonance frequency of said transmission side filter, wherein each of said resonators has an open-circuit end and a short-circuit end axially opposite to said open-circuit end, each of said resonators having a bore which is opened at said open-circuit end and said short-circuit end, said bore having a first portion with a first cross sectional area at a side of said resonator with said open-circuit end to provide a first characteristic impedance of the resonator and a second portion, at a side of said resonator with said short-circuit end, with a second cross sectional area different from said first cross sectional area to provide a second characteristic impedance of the resonator, and each of said first and second characteristic impedance ratios is derived by dividing said first characteristic impedance by said second characteristic impedance.

* * * * *